US006032340A

United States Patent [19]

Greif et al.

[11] Patent Number: 6,032,340

[45] Date of Patent: Mar. 7, 2000

[54] METHOD AND DEVICE FOR PRETREATMENT OF A CARPET YARN HAVING TINY FINE HAIRS ON ITS SURFACE

[75] Inventors: Steffen Greif, Spitzkunnersdorf; Heinz Grüber, Tönisvorst; Peter Pfeiffer, Olbersdorf; Arne Wussing, Lückendorf; Ingo Lison, Seifhemmersdorf, all of Germany

[73] Assignee: Kusters Zittauer Maschinenfabrik GmbH, Zittau, Germany

[21] Appl. No.: 09/292,303

[22] Filed: Apr. 15, 1999

Related U.S. Application Data

[62] Division of application No. 08/877,689, Jun. 17, 1997, Pat. No. 5,903,962.

[30] Foreign Application Priority Data

Jun. 21, 1996 [DE] Germany ..... 196 24 910

[51] Int. Cl.[7] ..... D02J 3/16

[52] U.S. Cl. ..... 28/166; 28/239

[58] Field of Search ..... 28/239, 166, 165, 28/173, 174, 219, 220, 272; 26/3, 4, 5, 6; 427/223, 224; 118/47; 432/59

[56] References Cited

U.S. PATENT DOCUMENTS

| | | | |
|---|---|---|---|
| 2,288,898 | 7/1942 | French | 28/239 |
| 2,444,553 | 7/1948 | Cone | 28/239 |
| 2,803,105 | 8/1957 | Stoddard | 28/239 |
| 3,154,836 | 11/1964 | Hoag, Jr. et al. | 28/239 |
| 3,402,447 | 9/1968 | Mettler | 28/239 |
| 3,524,233 | 8/1970 | Vorderbrugge | 28/239 |
| 3,562,488 | 2/1971 | Heimes | 28/239 |
| 3,874,046 | 4/1975 | Aschwanden et al. | 28/239 |
| 3,935,623 | 2/1976 | Mettler | 28/239 |
| 4,691,947 | 9/1987 | Burkhardt et al. | 28/272 |
| 5,552,097 | 9/1996 | Schippers | 28/240 |

FOREIGN PATENT DOCUMENTS

| | | |
|---|---|---|
| 840744 | 5/1970 | Canada . |
| 160 312 | 5/1904 | Germany . |
| 580 708 | 6/1933 | Germany . |
| 1 685 937 | 3/1972 | Germany . |
| 21 58 157 | 5/1973 | Germany . |
| 2158157 | 5/1973 | Germany . |
| 31 33 406 A1 | 4/1982 | Germany . |
| 3133406 | 4/1982 | Germany . |
| 195 06 369 | 8/1995 | Germany . |

OTHER PUBLICATIONS

"Higher Quality by Singeing Yarns," Article from Melliand Textilberichte, vol. 2 (1990), pp. 96–99.

*Primary Examiner*—Amy Vanatta
*Attorney, Agent, or Firm*—Kenyon & Kenyon

[57] ABSTRACT

A method for pretreating a staple-fiber carpet yarn (5) before it is processed to make a carpet, in order to reduce the hairiness and fuzz accumulation associated with such yarns. The surface of the carpet yarn (5) is exposed for a brief time to the action of a temperature which is very high relative to the characteristic temperatures of the carpet yarn material. This can be carried out in a singe burner (100) through which the carpet-yarn threads (5) are guided in their length-wise direction.

22 Claims, 2 Drawing Sheets

METHOD AND DEVICE FOR PRETREATMENT OF A CARPET YARN HAVING TINY FINE HAIRS ON ITS SURFACE

CROSS-REFERENCE TO RELATED APPLICATION

This application is a division of U.S. Ser. No. 08/877,689, filed Jun. 17, 1997 which issued on May 18, 1999 as U.S. Pat. No. 5,903,962.

FIELD OF THE INVENTION

The present invention relates generally to carpets yarns, and more particularly to a method and device for pretreating staple-fiber carpet yarns and other carpet yarns having tiny fine hairs on their surface.

RELATED TECHNOLOGY

In addition to natural fibers, staple-fiber yarns (spun yarns) made of polyamide fibers (PA6, perlon; PA6.6 nylon), polypropylene, polyester or other man-made fibers, as well as of blends of such fibers, are being used to manufacture tufted, woven or knitted carpets. The staple-fiber carpet yarns are spun from staple fibers, i.e. from fibers of a defined length.

Staple-fiber yarns have the advantage, inter alia, that they are able to be dyed well and uniformly, and that the dyed carpets produced from them have a uniform appearance. However, a disadvantage of these carpet yarns, whether made of natural or synthetic fibers, is that they are very hairy, i.e., the ends of the individual fibers forming the yarn are not merged into the yarn, but rather stick out from the yarn, so that under mechanical action, they can be separated or pulled out from the yarn. Such staple-fiber yarns are strongly inclined to fuzz.

This leads to heavy deposits of fuzz in the machines and installations processing these yarns, which then must be cleaned accordingly. The necessary cleaning either requires a substantial outlay from the standpoint of machine technology (filter systems, brushes, suction installations) if the cleaning is to be performed continuously or else results in costly equipment downtime.

Such an accumulation of fuzz and wearing-away of fibers occurs not only when manufacturing and finishing such carpets, but also during their use, especially during the initial phase after installation.

The result of these problems with staple-fiber carpet yarns is that, despite their economic and dyeability advantages, in recent years the world-wide market share of staple-fiber carpet yarns has been decreasing and shifting toward an increased use of filament yarns, which represent an alternative to staple-fiber carpet yarns. Filament yarns are not spun from individual, thin staple fibers, but rather are made of individual, continuous synthetic-material fibers extruded from fine dies, the fibers in themselves being compact and several of them being intertwined to form the yarn to be processed. If desired, several such yarn hanks are twisted to form a thicker carpet yarn.

The shift to filament yarns has occurred even though they have disadvantages compared to the staple-fiber yarns. While filament yarns, because of their construction, may not have the fuzzing problem associated with staple-fiber yarns, they still cannot be dyed as efficiently. Filament yarns also do not have very good mechanical properties. For example, they exhibit a poorer "retractive force" in response to intermittent loading over time. Mechanical stresses such as foot prints or pressure points from objects or furniture feet placed on the carpets continue to be visible for a long time after the pressure action has ceased. Dyed carpets produced from filament yarns also often have an unequal, unlevel, often streaky appearance.

These circumstances were the reason for varying efforts over the years to promote spun yarns, the aim of these efforts being to reduce fiber hairiness, and, consequently, the accumulation of fuzz. Thus, for example, fiber blends were produced which had other fibers having a lower melting point blended into the core fibers, to try to enable the fine, projecting, individual, small hairs to be subsequently bonded to the yarn by means of a thermal treatment.

Attempts also were made to use different chemical applications to, as it were, glue to the yarn the individual small hairs which are not securely merged into the yarn and which cause the fuzz formation.

All the methods tried heretofore have not led to the desired result, namely, the production of a usable, clean yarn made from spun staple fibers that is able to be economically produced.

Other carpet yarns may have similar problems to staple carpet yarns described above, for example, carpet yarns produced from natural fibers, as well as mixtures of natural and synthetic fibers, and the present invention is applicable to these hairy carpet yarns as well. In the same way, it makes no difference whether the carpet yarn is intended for the pile or for the back of the carpet.

SUMMARY OF THE INVENTION

An object of the present invention is to pretreat a hairy carpet yarn in a way that will enable the fuzz accumulation to be reduced without entailing substantial outlay and without having a disadvantageous effect on the mechanical yarn properties and the dyeing behavior.

The present invention therefore provides a method for pretreating a carpet yarn having fine, tiny hairs on its surface before it is processed to make a carpet, characterized in that the surface of the carpet yarn is exposed for a brief duration to the action of a temperature that is very high relative to the characteristic temperatures of the carpet yarn material.

Surprisingly, it has turned out that, by means of the temperature treatment, the individual tiny hairs sticking out from the carpet yarn, in so far as they are synthetic yarns, disappear nearly without residue, in that they vaporize or sublime, and specifically, in a manner that the yarn itself does not undergo any thermal fiber damage. In the case of natural fibers, the projecting, individual, small hairs burn. In this manner, a clean yarn is formed, whose surface is almost completely free of projecting tiny hairs. Of course, the method requires exact control, with due consideration of the operating speed, the temperature acting on the yarn surface, and the yarn material. In this connection, the expression "on its surface during a brief exposure time" means that a sharp temperature gradient with respect to the yarn is produced from the outside to the inside, so that a high temperature acting outside affects the tiny hairs sticking out from the surface, while the inner volume of the yarn hank still experiences no substantial increase in temperature during the brief exposure time and remains unchanged.

"Characteristic temperatures" are understood as the values such as glass point, melting point and ignition temperature. The very high temperatures should lie markedly, e.g. at least 500° C., above these, temperatures, to enable thorough removal of the tiny hairs in the brief exposure times and to allow adequate operating speeds, at the same time, the heat not yet penetrating substantially into the interior of the carpet yarn and fiber damage thus being prevented.

It is also possible, in another regard, to selectively and reproducibly influence the carpet yarn in different ways by way of the mentioned control. Thus, in addition to the degree of cleanliness, the surface hardness or the flexural strength of the carpet yarn can be increased as desired, depending on the application case. By this means, the hand or the crush resilience of the carpets produced from such carpet yarns can be influenced.

An important point is also that the staple-fiber carpet yarns subjected to the thermal treatment are able to be better dyed, and a more uniform, level appearance results.

A further advantage of the method according to the present invention is attained when the thus treated fibers are used to manufacture carpets to be imprinted. A drawback of the hairy and fuzz-afflicted staple-fiber carpet yarns used under known methods heretofore was that they were only able to be to imprinted very poorly or not at all. First of all, the hairiness and the fuzz accumulation quickly clogged the printing screens, and secondly, a sharply-contoured, level print image is difficult or almost impossible to produce on such carpets.

Great disadvantages exist in processing unclean yarns, both in the pile and back areas, when weaving carpets, as well. The heavy fuzz accumulation necessitates frequent cleaning resulting, accordingly, in shutdowns of the weaving machines, and involves costly suction and cleaning devices. Cleaning the yarns by means of a thermal treatment according to the present invention eliminates these problems to the greatest extent possible.

Finally, the thermal treatment of the present invention greatly aids in fixing the mechanically produced twisting of the individual fibers to form a carpet yarn. To bulk the carpet yarns and to fix the yarn twist (bulking and heat-setting), special machines and processes are used, representing a costly part of the installation, in which the carpet yarn is exposed to the action of overheated steam or saturated steam under excessive pressure. Inserting the thermal treatment of the present invention into the yarn-production process can reduce the expenditure for fixing aggregates. This leads to cost reductions in the yarn production.

The thermal treatment method of the present invention can be easily integrated into existing installations. For the most part, the location where the treatment is carried out within the installation is able to be selected. If a part of the installation is available for the heat-setting, then it may be that, in principle, the treatment can be carried out after the fixing process and before the winding-up operation, but implementation of the thermal treatment between the warp creel and the heat-setting apparatus is preferred. The temperature treatment can also be applied as a completely separate operation.

As already mentioned, the material primarily coming into consideration for the present invention is staple-fiber carpet yarn, especially made of fully synthetic material such as polyamide, polypropylene, polyester or the like.

In the preferred specific embodiment, the carpet yarn is moved lengthwise through a zone where the high temperature prevails and which is traversed in the moving direction in a time of 3 to 50 milliseconds.

Thus, the staple-fiber carpet yarn is passed quickly through a high-temperature treatment zone, so that, because of their small diameter and low thermal capacity, the projecting tiny hairs do, in fact, reach a high temperature virtually instantaneously and burn, vaporize or sublime, but the inner volume of the yarn, because of the poor thermal conductivity of the material, has no time to heat up substantially.

The treatment can especially be effected in such a way that a flat carpet warp-yarn sheet is moved through at least one elongated, narrow zone that extends transversely to the carpet warp-yarn sheet and has the high temperature.

To promote the evenness of the temperature action, this can be carried out from both sides of the flat carpet warp-yarn sheet.

The expression "transversely" is supposed to refer both to an arrangement perpendicular to the carpet warp yarn sheet, as well as to an oblique arrangement, by means of which the extent of the exposure zone can be increased in the moving direction of the carpet yarn threads, if desired, without having to make adjustments on the treatment device.

Another possibility is to pass the individual carpet-yarn threads through a heat source of any form surrounding them, e.g. a nozzle or a ring burner.

The preferred temperature range of the treatment according to the invention for the carpet yarns that come under consideration in the manufacture of carpets lies at 800 to 1700° C., in which case the exposure time should not be more than a few milliseconds, for instance three to 50 milliseconds. However, even higher temperatures can come into consideration.

With the temperatures and times mentioned, the interior of the carpet yarn is not yet substantially affected by the temperature rise and, moreover, substantial carpet-yarn feed rates of 300–800 m per minute are still rendered possible.

The preferred specific embodiment for creating a high-temperature defined zone, through which the carpet yarn is guided, is a singe device in which, therefore, the high temperature is produced by burning gases.

Suited for this purpose are high-efficiency singe burners, which are adapted to the treatment of carpet yarns, and have a sharp, narrow, high-energy and very hot flame, as are used in a similar design in singeing machines for textile fabrics. The flame gases have the "very high temperatures". Many individual threads or, as is customary in the case of heat-setting because of the better manipulability, only four or six individual threads can be processed simultaneously side-by-side in a flat warp-yarn sheet.

Although singeing has been known for decades in the field of textile fabrics and has been continually further developed (German Patent No. 500 153; German Laid Open Document 20 23 782; EP-A1 274 649), and in special cases has already even been used for yarns, especially sewing yarn (M. Peter and H. K. Rouette "Grundlagen der Textilveredlung" [Fundamentals of Textile Finishing], 13th edition, (1989) Deutscher Fachverlag, Frankfurt am Main, p. 400), thermally treating hairy carpet yarns, in particular staple-fiber carpet yarns made of synthetic material, has not been considered in known methods heretofore. The technical world had to "live" with the problems of hairiness and fuzz accumulation described herein, and tried—unsuccessfully—to reduce them using other methods.

As an alternative, the staple-fiber carpet yarn can also be exposed to the short-term action of a high temperature in another manner, for example, by means of a laser.

To concentrate the effect of the high temperature even more on protruding, tiny hairs, or to protect the main volume of the carpet yarn from a disadvantageous temperature rise, the carpet yarn can be moistened before the temperature treatment. Methods suitable for this, e.g. spraying on atomized moisture, condensation of vapor or the like, are found in related art.

After the temperature treatment, i.e., when the carpet yarn has left the singe burner but still has an elevated temperature, it is advisable to cool it by blowing on it a fluid medium to allow quick, problem-free further processing of the treated carpet yarn.

An air-water mixture has proven to be particularly effective for this purpose.

Should moisture still remain on the carpet yarn, then it can be removed by a drying process.

As already mentioned, one important aspect of the present invention is that the temperature treatment not only rectifies the fuzz problem in the manufacturing and finishing of the carpets and also at least in the initial phase of their use, but also that this action is associated with further advantageous effects. First, the temperature treatment has the effect of supporting the fixing of the yarn twist, which improves the mechanical properties of the yarn, such as bulk and crush resilience and possibly, in certain cases, permits at least partially dispensing with the fixing aggregates otherwise especially provided for that purpose. Second, the temperature treatment is associated with an improvement in the dye affinity of the staple-fiber carpet yarn, so that the color yield is higher. In this manner, cost savings are achieved which, in and of themselves, already justify the treatment operation of the present invention Notwithstanding the possible contribution that the pretreatment method according to the present invention, taken by itself, makes to the fixation of the carpet yarn, one important use lies in combining the temperature treatment with the yarn fixation process so that the pretreatment of the carpet yarn under the action of the very high temperature is combined with a yarn treatment according to the heat-setting process. Such a combination, with the temperature treatment preferably being carried out before the heat-setting process, yields a carpet yarn with improved properties, which are evident both in the carpet fabrication processing and in the finishing of the carpet, as well as when the carpet is used.

The present invention further provides for the utilization of the yarn-singeing method for pretreating staple-fiber carpet yarns prior to their processing to make a carpet.

The present invention also provides a device for implementing the method, characterized in that the device comprises a singe burner (100,100') having a singe channel (10) which is formed in a housing (7,7'), has a straight axis, is open at both ends (10,10"), and through which at least one yarn thread (5), stretched in its lengthwise direction, is able to be passed with a conveying direction (6) running parallel to the axis of singe channel (10), and that, provided in the area of entrance (10') of singe channel (10) at either side of yarn thread (5) are mutually opposed burner nozzles (15,15') whose gas-mixture jets (19,19') can heat or contact the tiny hairs protruding from the carpet yarn surface.

In doing this, one important aspect is that the burner flames and the conveyance of the yarn threads have meaningful parallel components, so that a type of tangential singeing is achieved which stresses the core thread only a little, and which is concentrated predominantly on the protruding tiny hairs.

The expression "having a parallel component" should be generously interpreted. Coming under this expression is an actually parallel alignment, but also an alignment at an acute angle, which can be 20° to 600°. An alignment in the same direction as the conveying direction is preferred, but an alignment in the opposite direction is not ruled out.

The conveying velocity of the carpet-yarn threads through the very high temperature zone is considerable, namely, 300 to 800 m/min. Devices for conveying carpet-yarn threads at these speeds are found in the related art.

In the preferred specific embodiment of the invention, an individual carpet-yarn thread is not treated, but rather a warp-yarn sheet of a plurality of carpet-yarn threads is treated. For this, it is expedient to design the singe channel so that singe channel (10) has an elongated cross-section, transversely to conveying direction (6), with a plane of symmetry (4), and wherein a plurality of yarn threads (5,5, . . . ) are able to be conveyed, with transverse clearance from one another, in plane of symmetry (4), through singe channel (10). The height of the singe channel transversely to the plane of symmetry may, e.g., be 8 to 20 mm and the length of the singe channel from the point of impact of the gas-mixture jets to the end of the singe channel situated in the conveying direction may be 100 to 300 mm, for example.

To strongly intermix the gas-mixture jets emerging from the burner nozzles, turbulence-producing grooves in inner walls (2,2') bordering singe channel (10) on its flat sides, the grooves running transversely to conveying direction (6), are recommended, as they improve the uniformity of the gas distribution, especially transversely to the conveying direction.

The burner nozzles expediently have small-diameter openings allowing sufficiently high velocities of the gas-mixture jets. "Openings" are understood to be both bore holes and narrow slits, whereby the "diameter" of the slits should be their cross-sectional dimension. The openings are arranged in a straight line, in the case of slits, they being situated with their longitudinal direction parallel to the line. The openings advantageously conform in width to the warp-yarn sheet.

At entrance (10') of singe channel (10), means (24), such as wall extensions, may be provided for restricting the channel cross-section to the size needed to only just allow yarn thread (5) to pass through unimpeded. This minimizes the ingress of infiltrated air at the entry of the singe channel. This infiltrated air, possibly pulled along by the rapidly running yarn threads, can make the burning process, which the stoichiometrically composed gas mixture is geared to, uneven.

For structural and handling reasons, it is preferable for the singe burner to be divided in the plane of symmetry, in particular, that it be able to swivel about an axis running parallel to the conveying direction, outside of the singe burner, or the two halves are detachable from one another transversely to the plane of symmetry.

In this manner, the singe burner can be opened and put into operation laterally adjacent to the warp-yarn sheet. This is expedient, in order to attain a uniform singeing result from the beginning of the yarn run and to avoid greater starting losses of the yarn. The singe burner is preheated in the closed state without yarn. After reaching the operating temperature, the yarn run is started and the singe burner is brought together with the running warp yarn sheet when in operation. In so doing, the singe burner can be guided into the warp-yarn sheet, or else the warp-yarn sheet can be guided into the singe burner. However, in principle, it is also possible to ignite the singe burner with the warp-yarn sheet in the singe channel at the start of the yarn run.

When the yarn run stops, it is possible to open the singe burner and guide the warp-yarn sheet out of the hot zone.

Dividing the singe burner also renders possible a design which is structurally simple and prevents the outer burner parts from heating up too much during operation, namely that singe burner (100,100') is formed by two refractory plates (1,1') that are provided with shallow depressions (3,3'), and are joined together with the open sides of depressions (3,3') facing one another, the depressions (3,3') together forming singe channel (10). The refractory plates (1,1') may be arranged in sheet-metal housings (7,7') and separated from the inner walls of sheet-metal housing (7,7') by an insulating back lining (8).

For operation of the burner, a pressure control is advised for supplying the gas mixture to burner nozzles (15,15') under such a pressure that the burning first starts at a short distance beyond burner nozzles (15,15'), viewed in conveying direction (6), so that the front of the flame is prevented from receding into the burner nozzles. The efficiency of the singe burner, and thus the temperature or the singe intensity, can also be adjusted or controlled through the pressure of the burnable gas mixture in the singe burner.

It is frequently necessary to cool the carpet yarn after leaving the singe burner, which can be carried out by nozzles (26) arranged downstream of singe burner (100,100') whose jets (27) strike carpet-yarn threads (5), cool them and free them of adhering material. The jets (27) may strike the carpet-yarn threads at a distance (25) of up to approximately 500 mm in conveying direction (6) beyond singe burner (100). Moreover, jets (27) may strike the carpet-yarn threads at an acute angle (β). Jets (27) also may be oppositely directed to conveying direction (6).

One important refinement of the invention as far as the apparatus aspect is concerned, as well, is the combination with a carpet-yarn fixing installation (heat-setting unit). The carpet-yarn fixing installation (heat-setting installation) (200) may be arranged downstream of singe burner (100).

BRIEF DESCRIPTION OF THE DRAWINGS

One exemplary embodiment of the device is illustrated schematically in the drawing, whose Figures show.

DETAILED DESCRIPTION

Figure 1:
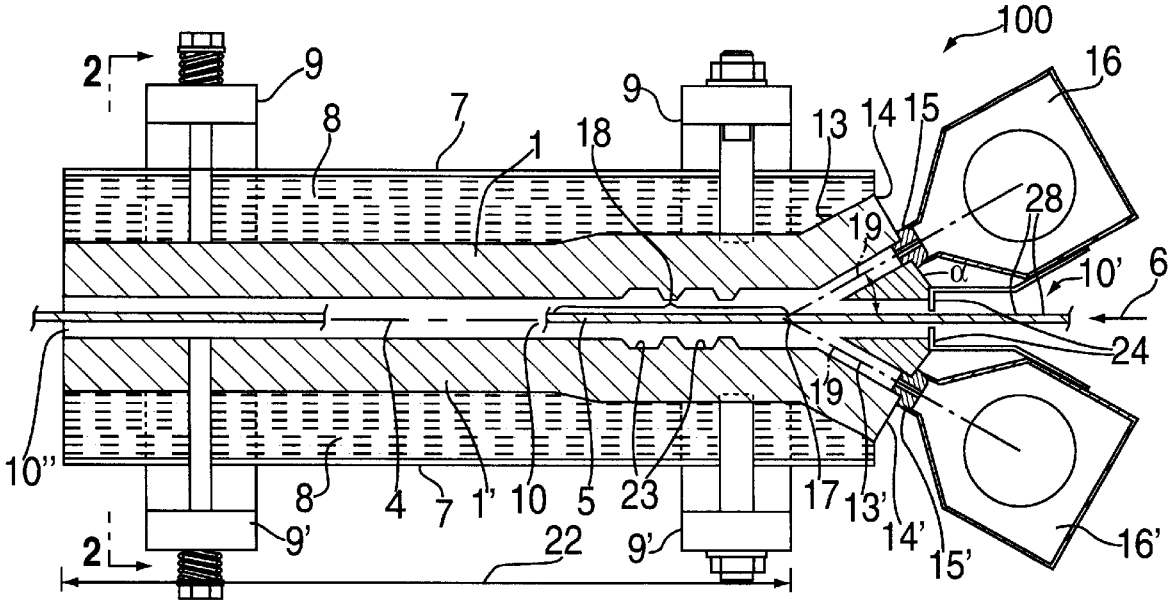
FIG. 1: a longitudinal section through the singe burner.
Figure 2:
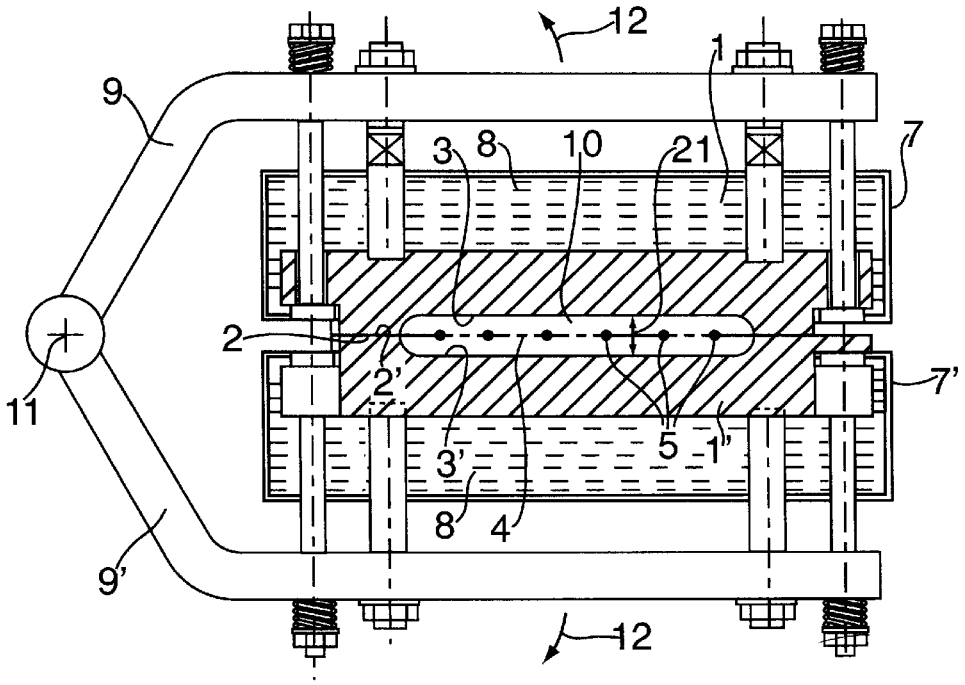
FIG. 2: a cross-section along the Line II—II in FIG. 1.

The singe burner, denoted as a whole by 100 in FIG. 1, comprises two identical ceramic plates 1,1', which are placed back-to-back with planar delimiting surfaces 2,2' facing one another (FIG. 2). Formed in delimiting surfaces 2,2', over the length of the refractory plates 1,1', are mutually opposed through-depressions 3,3' which together form a traversing singe channel 10 that is open at the ends, has a straight axis, and which, in a transverse plane, has the elongated cross-section, apparent from FIG. 2, with a plane of symmetry 4 situated parallel to the longitudinal direction of the cross-section and containing the axis. The height 21 of singe channel 10, transversely to the plane of symmetry 4 (FIG. 2), is approximately 8 to 20 mm; in the exemplary embodiment more or less 12 mm. The length 22 of singe channel 10 from location 17, where the nozzle jets strike plane of symmetry 4 and where the very high temperature zone 18 begins, to end 10" of singe channel 10 is 100 to 300 mm; in the exemplary embodiment 200 mm. The described embodiment of the device reveals a treatment zone that extends in conveying direction 6 of yarn threads 5 and has the very high temperatures only in the leading area, but an after-effect is still present because the carpet-yarn threads 5 and the hot gases produced by the burning pass through singe channel 10 together. In the area of very high temperature zone 18, grooves 23 running in the transverse direction are provided in delimiting planes 2,2', the grooves promoting turbulence in the burning gas-mixture stream and evening out 5 the temperature distribution in the transverse direction of singe channel 10. Planar delimiting surfaces 2,2' lie in plane of symmetry 4 in which a warp-yarn sheet of parallel, side-by-side carpet-yarn threads 5 is able to be conveyed in their longitudinal direction through singe channel 10 in a conveying direction 6 parallel to the channel direction. In the exemplary embodiment, there are six carpet-yarn threads 5 lying side-by-side with transverse clearance. The means of conveyance, provided outside of singe burner 100 for carpet-yarn threads 5 permit a high conveying speed of 300 to 800 m/min; in the exemplary embodiment, approximately 500 m/min.

The refractory ceramic plates 1, 1' are each accommodated in sheet-metal housings 7,7' which surround them and whose inner walls have clearance from the periphery of refractory ceramic plates 1,1', the intervening space being filled with insulating mineral wool 8.

Ceramic plates 1,1' are retained in their housings 7,7' on holders 9,9' which extend outside of housing 7,7' to both sides of plane of symmetry 4 and which are supported on one another on one side outside of housing 7,7' about an articulated axle 11 extending parallel to conveying direction 6, about which housings 7,7' are able to swivel in the direction of arrow 12.

Formed at the entrance 10' of singe channel 10 and extending across its width are inclined gas ducts 13,13', whose median plane forms an angle α with plane of symmetry 4 or carpet-yarn threads 5, the angle being 30° in the exemplary embodiment. Provided at the entrance-side front end 14,14' of refractory ceramic plates 1,1' are gas-mixture nozzles 15,15', which are compactly distributed over the width of singe channel 10, have openings in the form of small-diameter bore holes, and are able to be supplied with a burnable gas mixture via supply chambers 16,16' made of sheet metal and extending across the width of refractory ceramic plates 1,1'. The gas-mixture jets 19, indicated in FIG. 1 only by emerging from burner nozzles 15,15' pass through gas-mixture ducts 13,13' and strike at a location 17 on plane of symmetry 4 in,which carpet-yarn threads 5 run. The gas mixture is ignited in a suitable manner giving rise to a very high temperature zone 18 in which the burnable gas mixture burns from the end of gas-mixture ducts 13 in conveying direction 6. Carpet-yarn threads 5 are conveyed in synchronism with the gas flow according to FIG. 1 from right to left through singe channel 10. On the entry side, carpet-yarn thread 5 still has tiny hairs 28 as indicated in FIG. 1. The projecting tiny hairs 28 are burned or vaporized in zone 18, or are partly fused onto the core threads, so that at the outlet 10" of singe channel 10, there are no longer any tiny hairs on carpet-yarn threads 5 which could easily loosen during further processing or use of the carpet and lead to fuzz formation.

To prevent yarn threads 5 that feed in conveying direction 6 at a high velocity from bringing too much infiltrated air into singe channel 10, the inner cross-section of singe channel 10 is restricted at entrance 10' by means of transversely mounted restrictors 24 to the extent that yarn threads 5 are only just able to pass through without making contact.

Figure 3:
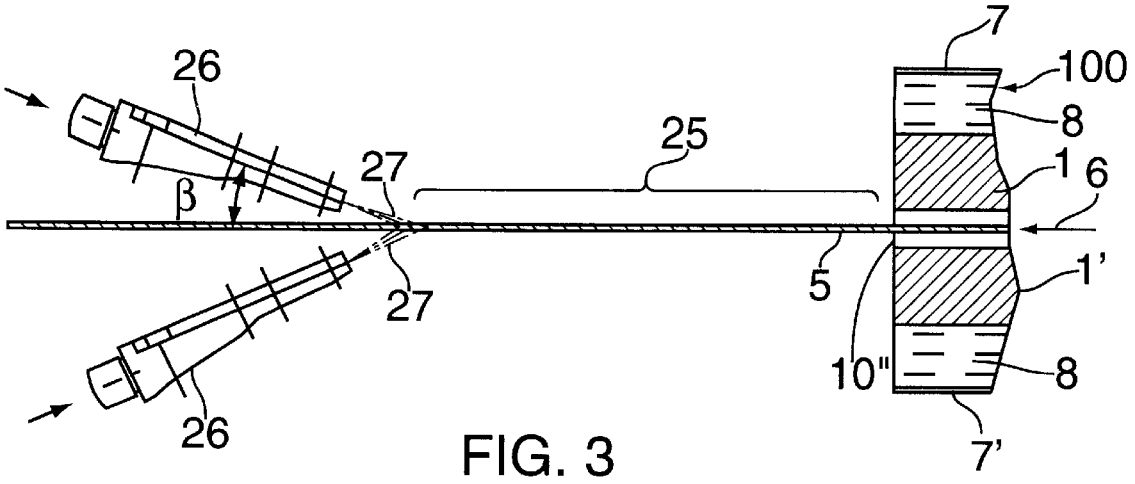
FIG. 3: a longitudinal section through a singe burner with air jets arranged downstream.

After leaving singe channel 10, carpet-yarn threads 5 are cleaned of clinging residues from combustion and simultaneously cooled by means of strongly acting air jets, as shown in FIG. 3. For this purpose, preferably fan jets 26 are arranged above and below carpet-yarn threads 5, at a distance 25 from end 10" of singe channel 10 of up to approximately 500 mm. In each case, air jet 27 is directed at acute angle β toward conveying direction 6 of carpet-yarn threads 5. Instead of air, a water-air mixture can also be used. Round slotted nozzles encircling each individual carpet-yarn thread 5 are possible, as well.

Figure 4:
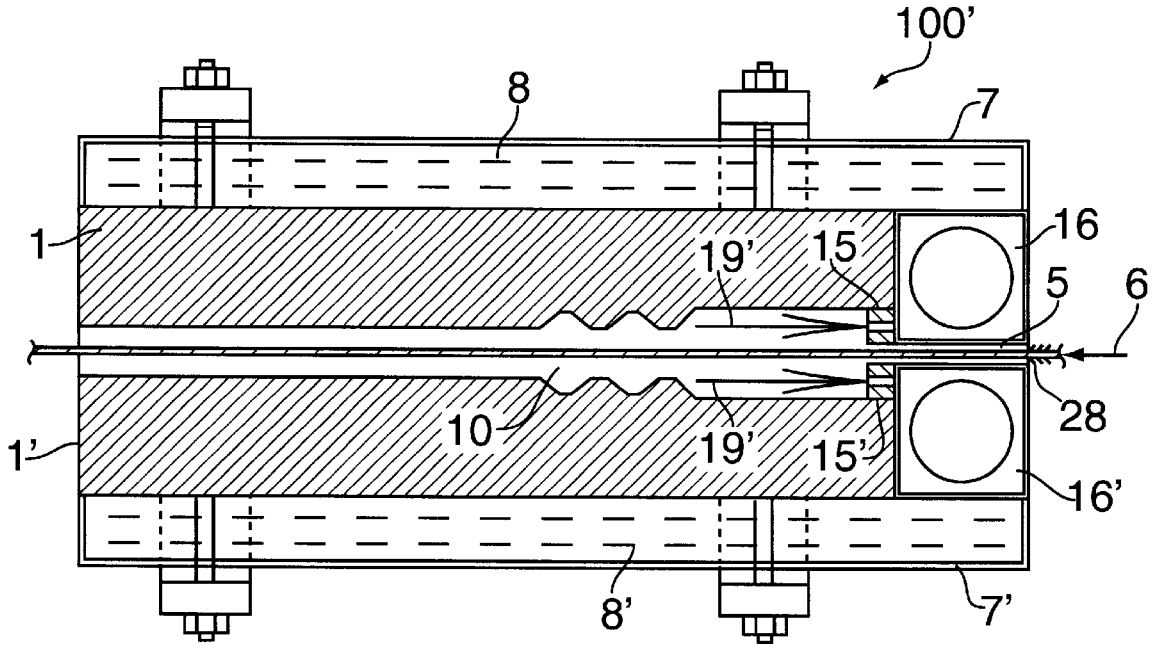
FIG. 4: a longitudinal section, corresponding to FIG. 1, through a modified singe burner.

FIG. 4 shows a modified specific embodiment of a singe burner 100', in which parts corresponding functionally to singe burner 100 are characterized with the same reference numerals. The difference consists only in the fact that supply chambers 16,16' are incorporated into housing 7,7' and, in particular, gas-mixture nozzles 15,15' are so arranged that gas-mixture jets 19' are directed parallel to and in synchronism with conveying direction 6.

Figure 5:
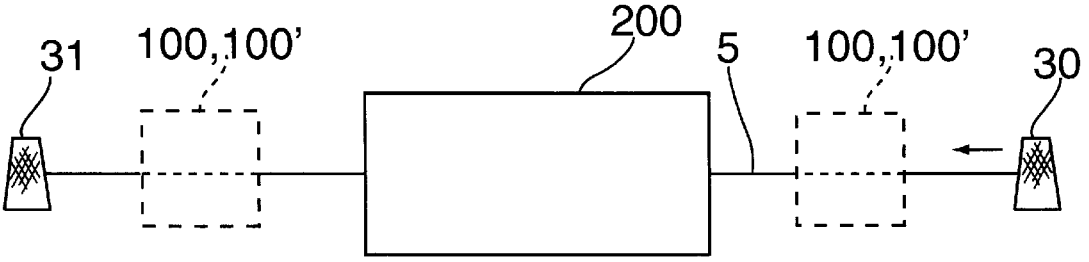
FIG. 5: a diagram of a relevant pretreatment installation.

FIG. 5 schematically represents a relevant pretreatment installation where the singe burner of the present invention (whether 100 according to FIG. 1 or 100' according to FIG. 4) is combined with a yarn-fixing installation (heat-setting installation). The single carpet-yarn thread 5 is reeled off from a supply spool 30, several times the number of supply spools being provided in an appropriate support stand as there are carpet-yarn threads 5 treated side-by-side in singe burner 100 in question, in order to assure a transition without stoppage.

In the preferred specific embodiment of the invention, carpet-yarn thread 5 runs, as shown by solid lines, into a singe burner 100 or 100', and then into a heat-setting apparatus 200, which is generally known and, therefore, is not described further, in which the yarn twist is fixed and the carpet yarn is bulked. Carpet-yarn thread 5 is subsequently wound in each case onto a supply spool 31.

In an alternative, possible embodiment, after being reeled off from supply spool 30, carpet-yarn thread 5 first runs through heat-setting apparatus 200 and only then passes through singe burner 100 or 100' of the type according to the invention indicated with a dotted line in FIG. 5, to then be wound onto supply spool 31. The singeing process can also be conducted separately, i.e., without a heat-setting apparatus. In this context, carpet-yarn thread 5 or the thread warp runs from a warp creel through singe burner 100,100' to the winding machine. In this case, it is advantageously possible to work with a greater number of carpet-yarn threads 5.

What is claimed is:

1. A device for pretreating a carpet yarn comprising:

a first ceramic plate and a second ceramic plate, a singe channel being formed between the first and second ceramic plates, the singe channel being open at a first end and a second end and allowing at least one yarn thread to pass through the singe channel;

a first burner; and a second burner opposite the first burner, the first and second burners angled at least partially toward the first end of the singe channel.

2. The device as recited in claim 1 wherein the first burner has a nozzle axis and the singe channel has a longitudinal axis, the nozzle axis and the singe channel axis being at an angle between zero and 60 degrees to each other.

3. The device as recited in claim 1 wherein a length of the singe channel is between 100 mm and 300 mm.

4. The device as recited in claim 1 further comprising an air jet at the second end.

5. The device as recited in claim 1 wherein the singe channel is sized to permit a plurality of yarn threads to pass through the singe channel.

6. The device as recited in claim 1 further comprising a conveyer for conveying the at least one yarn thread through the singe channel at a speed of 300 to 800 meters/min.

7. The device as recited in claim 1 wherein the first ceramic plate has a side facing the second ceramic plate, the side having grooves transverse to an axis of the singe channel.

8. The device as recited in claim 1 further comprising housing for housing the first and second ceramic plates.

9. The device as recited in claim 8 further comprising insulating mineral wool between the housing and the first and second ceramic plates.

10. The device as recited in claim 8 further comprising axle articulated axle connected to the housing for permitting the first and second ceramic plates to be moved relative to one another.

11. The device as recited in claim 1 wherein the first and second ceramic plates contact each other.

12. The device as recited in claim 1 wherein the first and second ceramic plates contact each other along planar surfaces.

13. The device as recited in claim 1 further comprising a spool for guiding the at least one yarn thread.

14. The device as recited in claim 1 wherein a distance between the first ceramic place and the second ceramic plate forming the singe channel is between 8 and 20 millimeters.

15. The device as recited in claim 1 wherein the first burner includes a first burner nozzle and a first supply chamber.

16. The device as recited in claim 15 wherein the first supply chamber is made of sheet metal.

17.The device as recited in claim 15 wherein the first burner nozzle contacts the first ceramic plate.

18. The device as recited in claim 1 wherein the first ceramic plate and the second ceramic plate are parallel to one another.

19. A device for pretreating a carpet yarn comprising:

a ceramic material, a part of the ceramic material defining a singe channel having a first end and a second end, the singe channel allowing at least one yarn thread to pass through the singe channel;

a first burner; and a second burner opposite the first burner, the first and second burners angled at least partially toward the first end of the singe channel.

20. The device as recited in claim 19 wherein the singe channel is enclosed by the ceramic material but open at the first end and the second end.

21. A device for treating a carpet yarn comprising:

a heat-setting device for heat setting at least one staple-fiber carpet yarn thread;

a singe burner having a singe channel open at a first end and a second end and allowing the at least one staple-fiber carpet yarn thread to pass through the singe channel;

a first burner; and a second burner opposite the first burner, the first and second burners angled at least partially toward the first end of the singe channel.

22. The device as recited in claim 21 wherein the heat-setting device is positioned downstream of the singe burner so as to heat set the at least one staple-fiber carpet yarn thread after singeing by the singe burner.

* * * * *

UNITED STATES PATENT AND TRADEMARK OFFICE

CERTIFICATE OF CORRECTION

PATENT NO. : 6,032,340
DATED : March 7, 2000
INVENTOR(S) : GREIF et al.

It is certified that error appears in the above-indentified patent and that said Letters Patent is hereby corrected as shown below:

Column 5, line 65, change "600°" to -- 60° -- ;

Column 8, line 9, delete "5";

Column 10, line 9, before "housing" (first occurrence) insert -- a --; and

Column 10, line 14, change "axle" (first occurrence) to -- an -- .

Signed and Sealed this

Seventeenth Day of April, 2001

*Attest:*

Nicholas P. Godici

NICHOLAS P. GODICI

*Attesting Officer*

*Acting Director of the United States Patent and Trademark Office*